US006007374A

United States Patent [19]

Sukegawa

[11] Patent Number: 6,007,374

[45] Date of Patent: Dec. 28, 1999

[54] CONNECTOR SOCKET

[75] Inventor: Akihito Sukegawa, Hitachinaka, Japan

[73] Assignee: Mitsumi Electric Co., Ltd., Japan

[21] Appl. No.: 09/031,791

[22] Filed: Feb. 27, 1998

[30] Foreign Application Priority Data

Feb. 28, 1997 [JP] Japan ..... 9-061851

[51] Int. Cl.[6] ..... H01R 13/60

[52] U.S. Cl. ..... 439/540.1; 439/76.2

[58] Field of Search ..... 439/76.2, 540.1, 439/638, 607

[56] References Cited

U.S. PATENT DOCUMENTS 4,577,917 3/1986 Nashimoto et al. ..... 439/638 X

*Primary Examiner*—Khiem Nguyen

*Attorney, Agent, or Firm*—Morrison Law Firm

[57] ABSTRACT

A connector socket uses a small number of connector pin types and prevents short circuits from occurring between external connection ends of the connector pins. A plurality of plug insertion openings are formed in molded block of insulating resin. A plurality of connector pins are disposed with connection ends projecting inside the plug insertion openings. External connection ends at the other end of connector pins are connected to a conductive body of a printed circuit substrate. The connector pins are fitted into pin slots at the back of the plug insertion openings. A portion of the connector pins, oriented along the direction in which the plug insertion openings are arranged, serves as shared connector pins.

12 Claims, 4 Drawing Sheets

CONNECTOR SOCKET

BACKGROUND OF THE INVENTION

The present invention relates to a connector socket for connecting electronic components. In particular, the present invention relates to a connector socket in which a plurality of plug insertion openings are arranged together.

Connector sockets for audio-visual equipment can be formed with a plurality of plug insertion openings so that a plurality of media devices, e.g., a plurality of VCRs, can be connected in parallel.

Referring to FIG. 4 and FIG. 5, a conventional connector socket comprises a molded block A formed by injection molding an insulating resin. Two plug insertion openings C1, C2 are formed on the surface of molded block A to allow insertion of plugs b1 of connector plugs B1, B2. A shield case D, formed by bending a thin metal plate into a box shape, covers the front surface, the side surfaces, and the upper surface of molded block A to shield the inside of the connector socket from external magnetic fields and electric fields. A plurality of pin slots E are formed in the back of molded block A. A plurality of connector pins F1, F2, F3, F4, are fitted into pin slots E using, for example, a fitting device (not shown). Connector pins F1, F2, F3, F4 are preferably stamped from a thin metal plate.

Connector pins F1, F2, F3, F4 are formed roughly in the shape of an "L". A connection end f1 projects inside the corresponding plug insertion opening C1, C2. An external connection end f2, extending perpendicular from connection end f1, passes through corresponding pin slot E, through the bottom surface of molded block A and through openings in a printed circuit substrate G. External connection ends f2 are soldered to a conductive body g1 of printed circuit substrate G.

A surface shield piece dl of shield case D is formed with two plug windows H1, H2, which correspond to plug insertion openings C1, C2. The side surfaces and the upper surface of molded block A are covered by side shield pieces d2, d3 and top surface shield piece d4, which are bent at right angles from surface shield piece d1.

Thus, with the structure of this conventional connector socket, connector pins F1, F2, F3, F4 must be produced in four different shapes. This increases the expense necessary for producing the dies for connector pins F1, F2, F3, F4 and a large number of steps is involved in insertion using the fitting device. This results in high production costs.

In the connector socket shown in FIG. 5, connector pins F1, F2, F3, F4 having different shapes are used for each of plug insertion openings C1, C2. External connection ends f2 of connector pins F1, F2, F3, F4, which are connected to printed circuit substrate G, are arranged so that they are separated by a very small pitch. This makes it possible for adjacent external connection ends f2 to become short-circuited when a conductive body gI of printed circuit substrate G is being soldered to external connection end f2.

OBJECT AND SUMMARY OF THE INVENTION

It is an object of the present invention to produce a connector socket which overcome the problems of conventional connector sockets described above and to provide a connector socket using a small number of connector pin types and which prevents short circuits from occurring between external connection ends of the connector pins.

In order to achieve the objects described above, a connector socket is proposed wherein a molded block of an insulating resin is formed with a plug insertion opening. A plurality of connector pins of the connector socket are disposed so that the connection ends of the connector pins project inside the plug insertion openings. The external connection ends on the other end of the connector pins are connected to a conductive body on a printed circuit substrate. The connector pins are attached to pin slots at the back surface of the plug insertion opening. The portion of the connector pin oriented along the direction in which the plug insertion openings are arranged serves as the shared connector pin. The external connection end of the shared connector pin is connected to the conductive body of the printed circuit substrate.

Briefly stated, the present invention provides a connector socket that uses a small number of connector pin types and prevents short circuits from occurring between external connection ends of the connector pins. A plurality of plug insertion openings are formed in molded block of insulating resin. A plurality of connector pins are disposed with connection ends projecting inside the plug insertion openings. External connection ends at the other end of connector pins are connected to a conductive body of a printed circuit substrate. The connector pins are fitted into pin slots at the back of the plug insertion openings. A portion of the connector pins, oriented along the direction in which the plug insertion openings are arranged, serves as shared connector pins.

According to an embodiment of the invention, there is provided a connector socket comprising: a molded block of an insulating resin, at least first and second plug insertion openings in the molded block, a plurality of pin slots in a back surface of the plug insertion opening, a plurality of connector pins in the pin slots, at least some of the connector pins being shared connector pins having a first connection end projecting inside the first plug insertion opening and a second connection end projecting inside the second plug insertion opening, the first and second connection ends being integrally formed with a shared section, whereby the first and second connection ends are electrically connected, and the shared connector pins including integrally formed external connection ends connectable to an external conductive device.

According to a feature of the invention, there is provided a connector pin for use in a connector socket comprising: a shared section, at least first and second connection ends extending generally perpendicular to the shared section, the first and second connection ends being spaced for insertion into first and second plug insertion openings of a connector socket, a first hammer receiving section on the shared section aligned with the first connection end, a second hammer receiving section on the shared section aligned with the second connection end, and an external connection end extending from the shared section for connection to an external conductive device.

The following is a summary of the preferred embodiments of the present invention.

1) The shared connector pins are stamped from a metal plate and comprise: a shared section extending in a direction parallel to the direction in which the plug insertion opening is aligned; a plurality of connection ends supported in a cantilevered manner from the shared section and extending roughly perpendicular to the shared section; and an external connection end formed continuously at least one end of the shared section.

2) A hammer-receiving projection is formed at the back of the shared section at a position corresponding to the base of a connection end, which is aligned with a plug insertion opening.

3) The connection end of the connector pin disposed in a plug insertion opening is staggered in the direction of the alignment-pitch, which is perpendicular to the direction in which the plug insertion openings are arranged.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
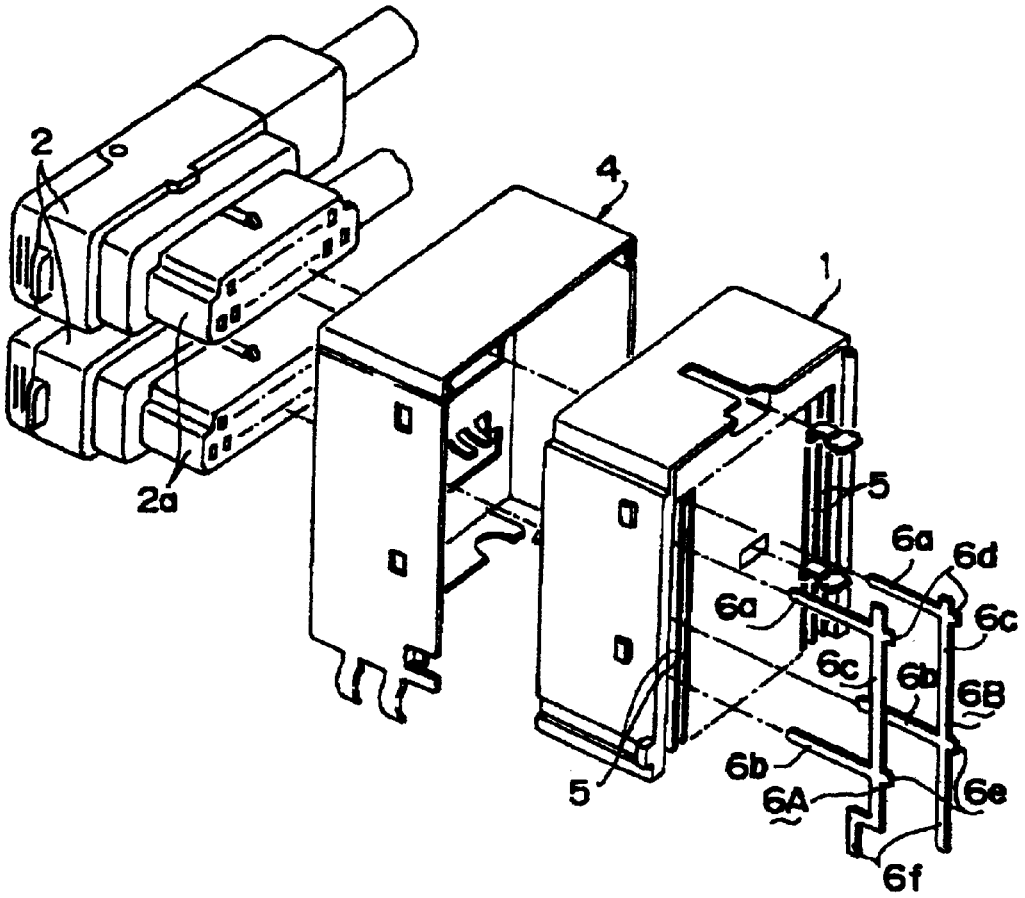
FIG. 1 is an exploded perspective drawing showing the relationship between the connector socket and the connector plug according to the present invention.
Figure 2:
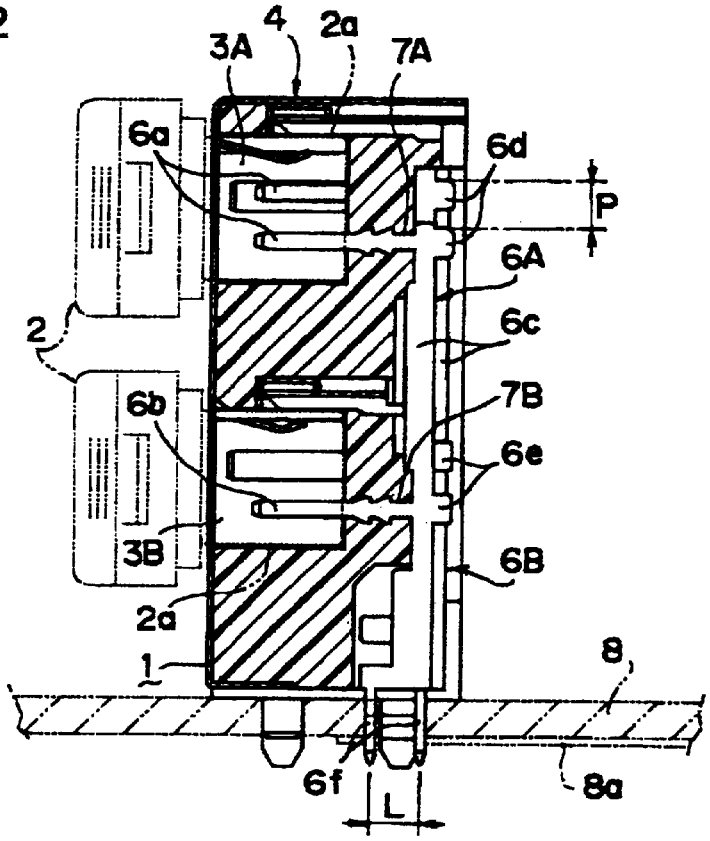
FIG. 2 is an enlarged cross-section drawing of the connector socket.
Figure 3:
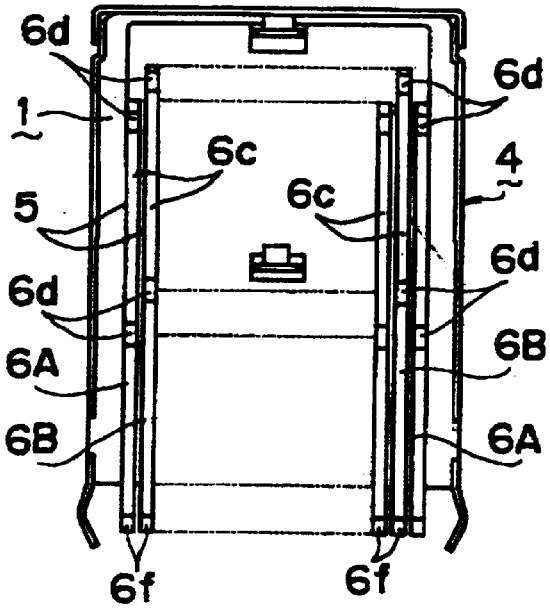
FIG. 3 is a rear view of the connector socket.
Figure 4:
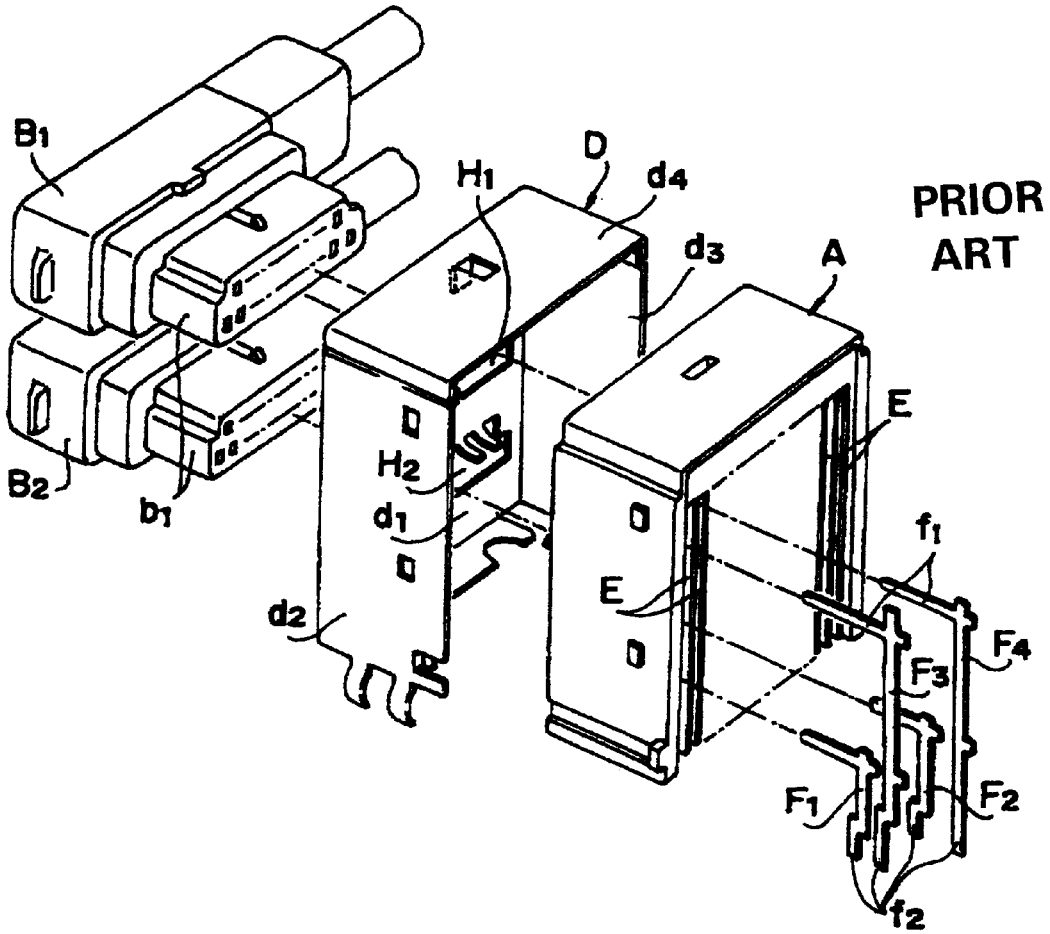
FIG. 4 is an exploded perspective drawing showing the relationship between the connector socket and the connector plug according to the prior art.
Figure 5:
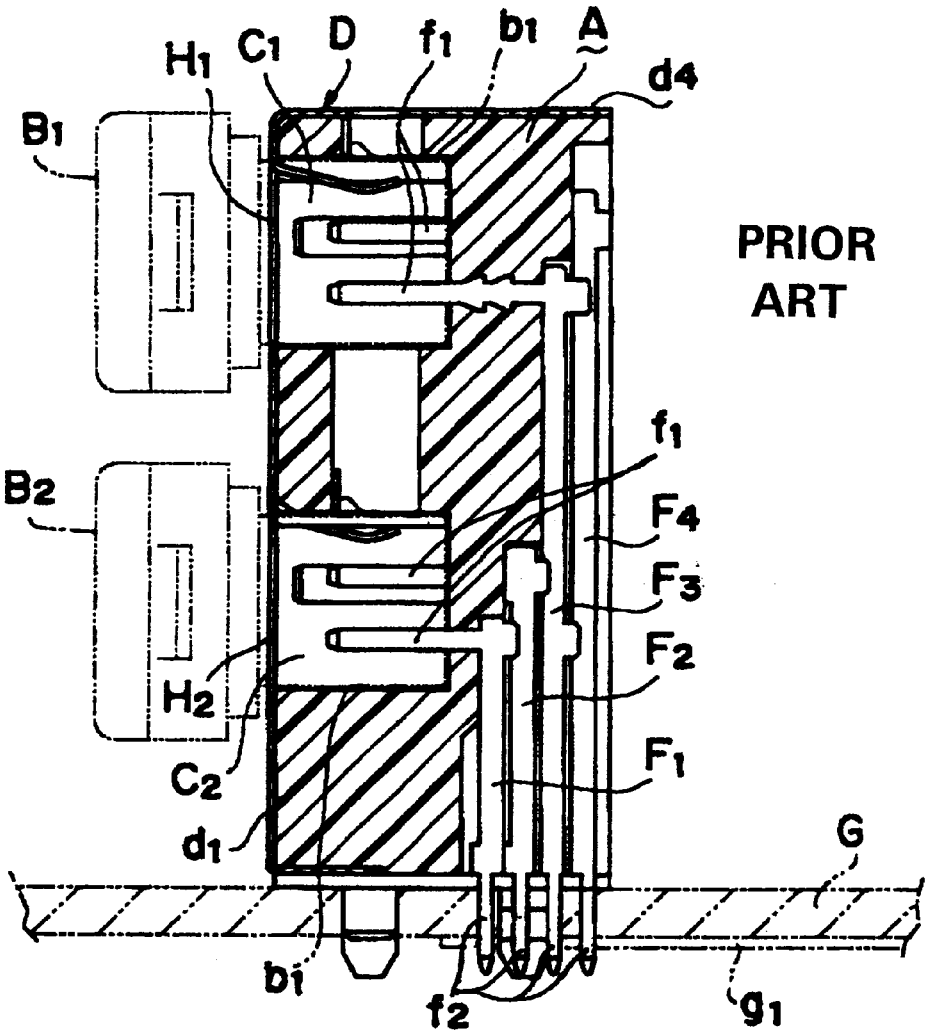
FIG. 5 is an enlarged cross-section drawing of the prior art connector socket of FIG. 4.

Referring to FIGS. 1–3, a connector socket A is protected from external magnetic and electric fields by a shield case 4 formed by bending a thin metal plate into a box shape covering the front surface, the side surfaces, and the upper surface of a molded block 1.

A plurality of pin slots 5 are formed at the back of molded block 1 so that they are adjacent to each other across the width of molded block 1. A plurality of shared connector pins 6A, 6B are fitted into pin slots 5 using a fitting device (not shown). Shared connector pins 6A, 6B are preferably stamped from a thin metal plate.

The corresponding connection ends in plug insertion openings 3A, 3B perform common functions. Thus, shared connector pins 6A, 6B comprise pairs of connection ends 6*a*, 6*b*, which are arranged adjacent to each other in the same manner as the arrangement of plug insertion openings 3A, 3B. Shared connector pins 6A, 6B each includes a shared section 6*c* extending vertically along corresponding pin slots 5. The base portions of connection ends 6*a*, 6*b* are supported by shared sections 6*c* in a cantilevered manner at roughly a right angle.

Connection ends 6*a*, 6*b* are inserted through openings 7A, 7B, which are formed between plug insertion openings 3A, 3B and pin slots 5. A fitting device is used so that the ends of connection ends 6*a*, 6*b* project into corresponding plug insertion openings 3A, 3B.

Integrally formed hammer-receiving projections 6*d*, 6*e* are disposed on the back surface of shared section 6*c*, in alignment with the bases of connection ends 6*a*, 6*b*.

Referring to FIG. 3, connector pins 6A, 6B and pin slots 5 are arranged so that pins that are adjacent along the width of molded block 1 (i.e., along the direction of the arrangement pitch) are offset slightly along the vertical axis, resulting in a staggered arrangement. The hammer-receiving projections 6*d*, 6*e* of connector pins 6A, 6B are also disposed in a staggered arrangement with a stagger pitch P.

On a lower portion of shared section 6*c* of shared connector pins 6A, 6B, there are integrally formed external connection ends 6*f* pointing downward. External connection ends 6*f* are soldered to a conductive body 8*a* of printed circuit substrate 8, on which molded block 1 is mounted. If the back surface of molded block 1 is a connector socket mounted to printed circuit substrate 8, external connection ends 6*f* are oriented perpendicular to shared section 6*c*.

Referring to FIG. 1, the entire connector socket can be made with two types of shared connector pins 6A, 6B. Referring to FIG. 2, an interval L between external connection ends 6*f* of shared connector pins 6A, 6B is made large.

In the connector socket according to the embodiment shown in the drawing, two types of connector pins are used comprising shared connector pins 6A, 6B. This reduces the cost required for dies.

With this connector socket, pushing shared connector pins 6A, 6B into pin slot 5 involves pushing in the two types of shared connector pins 6A, 6B into the two plug insertion openings 3A, 3B. This simplifies the insertion operation and reduces the time involved in assembly. Also, in the insertion operation for shared connector pins 6A, 6B, hammer-receiving projections 6*d*, 6*e*, which are aligned with the bases of connection ends 6*a*, 6*b*, can be hit with the hammer head of the fitting device. This makes it possible to reliably insert connection ends 6*a*, 6*b* into corresponding plug insertion openings 3A, 3B.

In this insertion operation, hammer-receiving projections 6*d*, 6*e* of adjacent shared connector pins 6A, 6B are offset from each other vertically. Thus, the application of force from the fitting device hammer head onto adjacent shared connector pins 6A, 6B is avoided.

As the description above makes clear, in the invention according to claim 1, a common shared connector pin is used to form connection points at a plurality of plug insertion openings. This decreases the cost of dies required for production of the connector pins, and reduces the labor cost for the simplified operation of inserting the connector pins.

The invention provides a structure that can easily accommodate a different numbers of plug insertion openings. For example, the invention is useable for a device adapted to three or more plug insertion openings. Also, the connection ends of the shared connector pins can be reliably inserted into the corresponding plug insertion openings, thus preventing errors in the operation of the fitting device hammer head.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A connector socket comprising:

a molded block of an insulating resin;

at least first and second plug insertion openings in said molded block;

a plurality of pin slots in a back surfice of said plug insertion opening;

a plurality of connector pins in said pin slots;

at least some of said connector pins being shared connector pins having a first connection end projecting inside said first plug insertion opening and a second connection end projecting inside said second plug insertion opening;

at least some of said connector pins including at least a first type of connector pin and a second tvpe of connector pin;

said first and second connection ends being integrally formed with a shared section, whereby said first and second connection ends are electrically connected;

said shared connector pins including integrally formed external connection ends connectable to an external conductive device;

said external connection end of said first type having a stagger with respect to said external connection end of said second type; and said stagger is along a direction of insertion of said connection ends.

2. A connector socket as described in claim 1 wherein said shared connector pin is a metal stamping.

3. A connector socket according to claim 1, wherein said shared connector pin includes:

a shared section extending between said at least first and second plug insertion openings;

said first and second connection ends being cantilevered to said shared section and extending generally perpendicular to said shared section; and said external connection end is continuous at least with one end of said shared section.

4. A connector socket according to claim 1, wherein said shared section extends generally in a direction defined between said at least first and second plug insertion openings.

5. A connector socket according to claim 1, wherein said external conductive device includes a printed circuit substrate.

6. A connector socket according to claim 1 wherein:

each of said shared connector pins includes first and second hammer-receiving projections on said shared section;

said first hammer receiving projection being aligned behind said first connection end, and said second hammer receiving projection being aligned behind said second connection end, whereby hammer driving of said first and second connection ends into said molded block is enabled.

7. A connector socket comprising:

a molded block of an insulating resin;

at least first and second plug insertion openings in said molded block;

a plurality of pin slots in a back surface of said plug insertion opening;

a plurality of connector pins in said pin slots;

at least some of said connector pins being shared connector pins having a first connection end projecting inside said first plug insertion opening and a second connection end projecting inside said second plug insertion opening;

said first and second connection ends being integrally formed with a shared section, whereby said first and second connection ends are electrically connected;

said shared connector pins including integrally formed external connection ends connectable to an external conductive device;

said at least some of said connector pins including at least a first type of connector pin and a second type of connector pin;

locations of said first and second connection ends of said first type having a stagger with respect to said first and second connection ends of said second type; and said stagger is along a direction of alignment-pitch, which is perpendicular to the direction in which said plug insertion openings are arranged.

8. A connector socket as described in claim 7 wherein said shared connector pin is a metal stamping.

9. A connector socket according to claim 7, wherein said shared connector pin includes:

a shared section extending between said at least first and second plug insertion openings;

said first and second connection ends being cantilevered to said shared section and extending generally perpendicular to said shared section; and said external connection end is continuous at least with one end of said shared section.

10. A connector socket according to claim 7, wherein said shared section extends generally in a direction defined between said at least first and second plug insertion openings.

11. A connector socket according to claim 7, wherein said external conductive device includes a printed circuit substrate.

12. A connector socket according to claim 7 wherein:

each of said shared connector pins includes first and second hammer-receiving projections on said shared section;

said first hammer receiving projection being aligned behind said first connection end, and said second hammer receiving projection being aligned behind said second connection end, whereby hammer driving of said first and second connection ends into said molded block is enabled.

* * * * *